US005184686A

United States Patent [19]

Gonzalez

[11] Patent Number: 5,184,686

[45] Date of Patent: Feb. 9, 1993

[54] METHOD FOR OFFSHORE DRILLING UTILIZING A TWO-RISER SYSTEM

[75] Inventor: Romulo Gonzalez, Slidell, La.

[73] Assignee: Shell Offshore Inc., Houston, Tex.

[21] Appl. No.: 695,652

[22] Filed: May 3, 1991

[51] Int. Cl.[5] ..... E21B 7/12; E21B 19/09; E21B 43/013

[52] U.S. Cl. ..... 175/5; 166/367; 166/358; 166/359

[58] Field of Search ..... 175/5, 7; 166/350, 358, 166/359, 367

[56] References Cited

U.S. PATENT DOCUMENTS

| | | | |
|---|---|---|---|
| 3,137,348 | 6/1964 | Ahlstone et al. | 166/88 |
| 3,179,179 | 4/1965 | Kofahl | 166/66.5 |
| 3,215,203 | 11/1965 | Sizer | 166/77 |
| 3,227,229 | 1/1966 | Wakefield, Jr. | 175/7 |
| 3,277,969 | 11/1966 | Vincent | 175/5 |
| 3,340,928 | 9/1967 | Brown | 166/0.5 |
| 3,532,162 | 10/1970 | Fischer | 166/0.5 |
| 3,554,277 | 1/1971 | Bauer et al. | 166/0.6 |
| 3,638,721 | 2/1972 | Harrison | 166/0.5 |
| 3,677,352 | 7/1972 | Lloyd | 175/7 |
| 3,913,668 | 10/1975 | Todd et al. | 166/0.5 |
| 3,971,576 | 7/1976 | Herd et al. | 166/359 X |
| 4,046,191 | 9/1977 | Neath | 166/0.5 |
| 4,147,221 | 4/1979 | Ilfrey et al. | 175/7 |
| 4,193,455 | 3/1980 | Steddum et al. | 166/55 |
| 4,427,073 | 1/1984 | Sykora | 166/364 |
| 4,466,487 | 8/1984 | Taylor, Jr. | 166/339 |
| 4,901,803 | 2/1990 | Levier | 175/5 |

*Primary Examiner*—William P. Neuder
*Attorney, Agent, or Firm*—Mark A. Smith

[57] ABSTRACT

A method for drilling offshore wells in deep water with greater safety and with fewer casing strings, maintaining a maximum diameter wellbore in the early stages of drilling to facilitate casing operations in and beyond deviated sections, and providing full well control while setting surface casing. This method utilizes a two-riser system for drilling in which the surface casing interval is run and set within a large diameter, light duty riser. Thereafter, drilling proceeds with a heavy duty riser.

15 Claims, 8 Drawing Sheets

METHOD FOR OFFSHORE DRILLING UTILIZING A TWO-RISER SYSTEM

BACKGROUND OF THE INVENTION

This invention relates to a method for drilling offshore wells and, more particularly, a method for drilling in deep water. The need to develop new reserves of oil and gas continues to drive hydrocarbon recovery operations into progressively deeper water and drives the need to reach ever deeper reservoirs. One problem encountered in deep water development is the cost of providing suitable platforms and other offshore facilities and the economics generally suggest getting the maxium advantage from each facility placed. The traditional approach includes extensive directional drilling to drain the largest area of reservoir possible. These influences can dictate that wells be drilled to a total length of four miles and more.

Whether drilling onshore or offshore, it is necessary to seal off the borehole wall as drilling progresses in order to control the geopressures, maintain the borehole wall and isolate the zones. This is temporarily accomplished for each interval of drilling with the filter cake deposited by drilling mud which also serves to cool the bit and flush away cuttings. After a given interval has been drilled and the drill string pulled, the borehole is permanently sealed with casing which is cemented to the borehole wall. Thereafter, the next interval is drilled through the last casing and, subsequently, sealed off with another casing which is concentrically run through the last previous casing, hung off and cemented in place. Thus, each interval results in another concentric casing, each progressively reducing the size of the wellbore available for further drilling, completion and production operations over the life of the well.

Directional wells drilled for extended reach make these problems worse because the reduced interior diameter is particularly difficult to run casing through when there are bends and/or shallow angle sections in the borehole.

Further, the offshore environment makes these operations more difficult because drilling in deep water from surface facilities requires an artificial "borehole" to be maintained from the sea floor to the surface facilities. This is provided by a hollow tubular member called a riser. The riser returns cuttings to the surface and holds a vertical column of drilling mud which maintains the hydrostatic head necessary to provide pressure controlled access to the wellbore while pulling the drill string, setting casing or running other tools.

However, the diameter of the riser itself is another limiting factor in offshore drilling operations. This limitation has, in past practice, led to removing the riser for setting at least the first conductor casing in order to set an early casing which is too large to pass through the riser. Alternatively, the conductor interval has been drilled without a riser. However, in either event the conductor casing included an integral high pressure housing and the surface interval was constrained by both the housing and a blowout preventer ("BOP") on the riser.

SUMMARY OF THE INVENTION

It is an object of the present invention to drill deeper, with greater safety and improved efficiency.

It is a further object of the present invention to maintain a maximum diameter wellbore in the early stages of drilling to facilitate casing operations in and beyond deviated sections.

Finally, it is an object of the present invention to provide full well control while setting surface casing without the limitations imposed by the high-pressure housing and the blowout preventer stack used in the prior art for this interval.

Toward the fulfillment of these and other objects, the present invention is a two-riser method of drilling in which a surface interval is drilled through a light-duty, large diameter first riser attached to a subsea wellhead and the surface casing is run through the first riser. After the surface casing is set and cemented in place within the borehole, the first riser is retrieved and a high pressure housing is run to the wellhead and sealed against the top of the surface casing. A heavy duty second riser is then attached to the subsea wellhead in sealed communication with the high pressure housing and further drilling operations are conducted through the second riser.

BRIEF DESCRIPTION OF THE DRAWINGS

The brief description above, as well as further objects, features and advantages of the present invention will be more fully appreciated by reference to the following detailed description of the preferred embodiments, which should be read in conjunction with the accompanying drawings in which.

DESCRIPTION OF PREFERRED EMBODIMENTS

Figure 1:
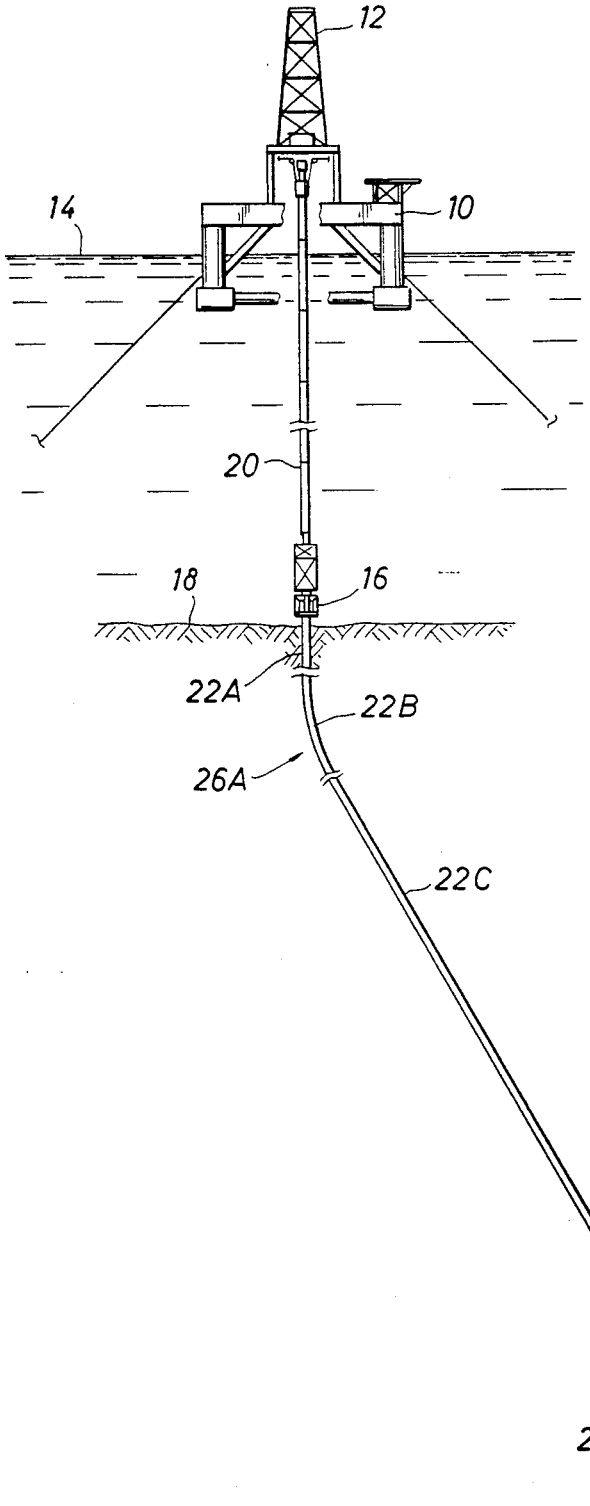
FIG. 1 generally illustrates a side elevational view of a deep water drilling operation.

FIG. 1 illustrates, generally, the environment of offshore drilling. Here, surface facilities 10, including a derrick 12, are provided above ocean surface 14. The surface facilities are connected to a subsea wellhead 16 at ocean floor 18 through a riser 20. Several lengths of casing 22A, B, and C, are hung from wellhead 16 sealing off the borehole wall as drilling advances. Extended reach drilling plans require the well to deviate from vertical in a controlled manner and can require bend 26A in regions of shallow angle progress 26B, both of which require additional tolerances to dependably pass casing strings.

Figure 2:
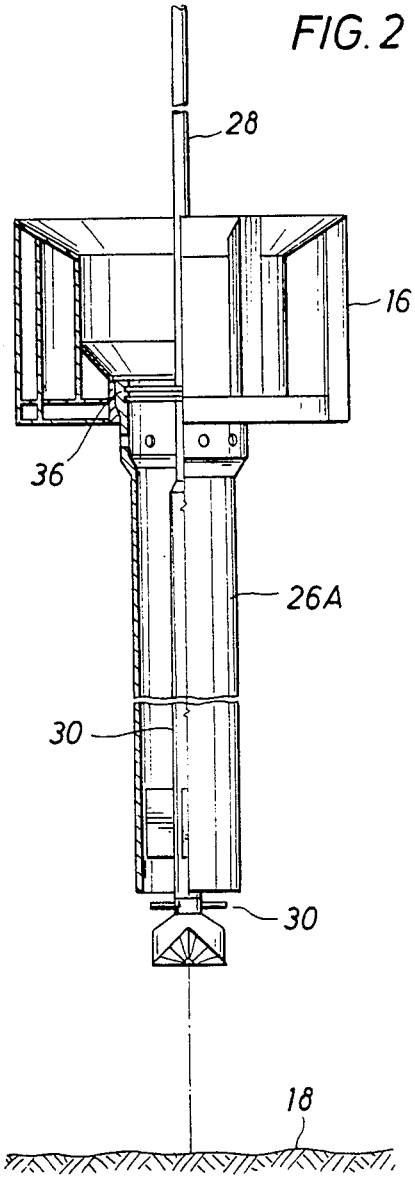
FIG. 2 illustrates a partially cross-sectioned, side elevational view of a wellhead and jetting assembly being run on a drill string.

In the preferred embodiment, practice of the present invention begins with setting a large diameter subsea wellhead 16. See FIG. 2. Alternatively, the wellhead may be provided on a subsea template. The drawworks of the surface facility lowers the subsea wellhead toward the ocean floor 18 on the end of drill string 28. Further, in the preferred embodiment, subsea wellhead 16 is provided with a structural casing 26A and the drill string running the wellhead terminates in a jetting assembly 30 which extends through and slightly out of the bottom of structural casing 26A.

Figure 3:
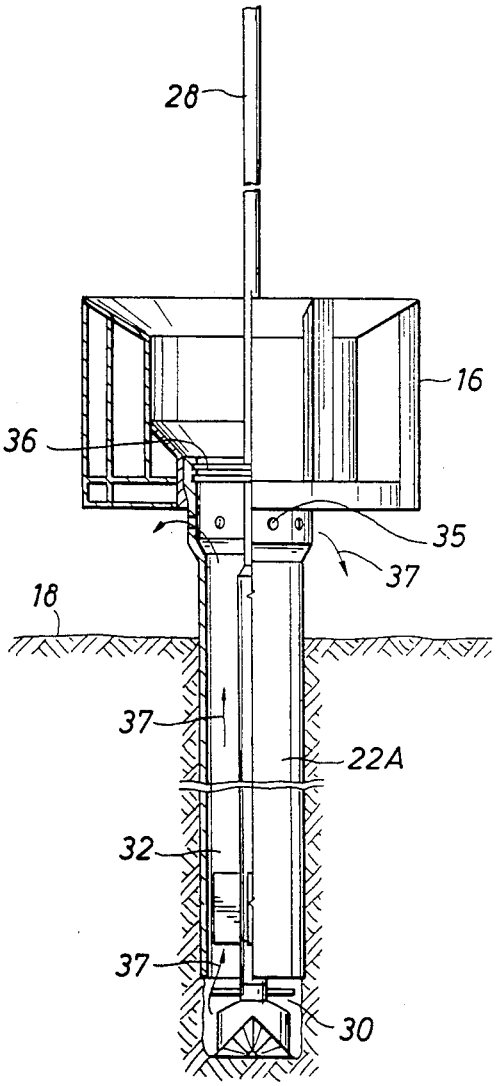
FIG. 3 illustrates a partially cross-sectioned side elevational view illustrating the jetting of the structural casing of the wellhead into the ocean.

Referring to FIG. 3, drilling fluid is pumped down drill string 28 through jetting assembly 30 as the subsea wellhead 16 approaches ocean floor 18. After touchdown, the jetting action sweeps the soft mud at the ocean floor up through annulus 32 between the structural casing and the jetting assembly and out ports 35. The passage of the drilling fluid and entrained mud is generally illustrated with arrows 37. Structural casing 26A advances into ocean floor 18 as the soft sedimentary material is swept away by the force of the jets.

Figure 4:
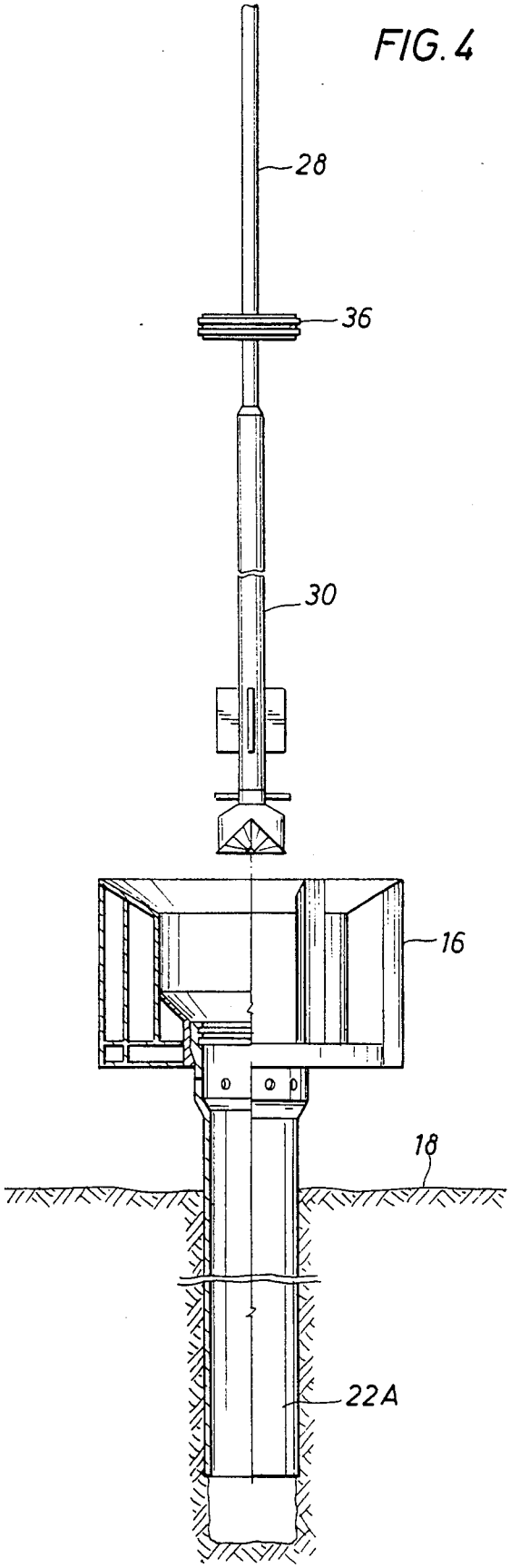
FIG. 4 is a partially cross-sectioned side elevational view illustrating retrieval of the jetting assembly after setting the wellhead at the ocean floor.

When subsea wellhead 16 is fully set in ocean floor 18, drill string 28 is released from the subsea wellhead. See FIG. 4. In the preferred embodiment, each of the joints along the drill string are made up with a right hand rotation and a running tool connection 36 between drill string 28 and subsea wellhead 16 makes up with a left hand rotation such that a right hand rotation of the drill string will unscrew the connection between the drill string and the subsea wellhead without loosening any joint along the drill string. FIG. 4 illustrates the disengaged drill string 28 with jetting assembly 30 being retrieved to the surface.

Figure 5:
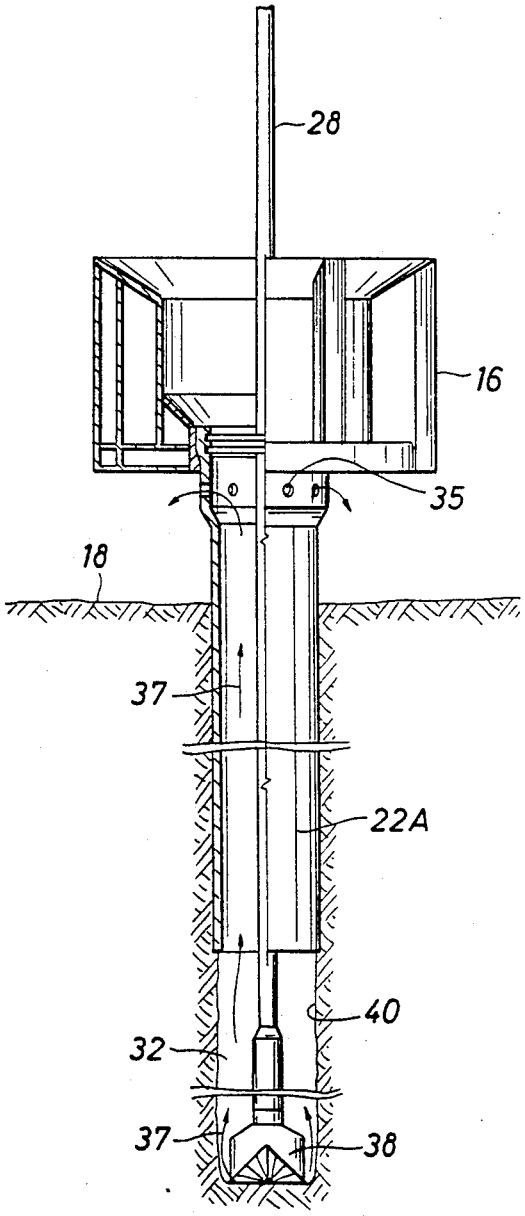
FIG. 5 illustrates a partially cross-sectioned side elevational view of drilling operations in which a large diameter conductor hole is created.

Referring now to FIG. 5, drill string 28 is then outfitted with a drill bit 38 and run back into subsea wellhead 16 and through structural casing 22A to drill an interval forming a conductor borehole 40. Drilling fluid circulating through the bit entrains the cuttings and carries those up annulus 32 through the conductor borehole and through the structural casing to discharge the fluid returns and entrained cuttings through ports 35 of subsea wellhead 16. The flow of fluid returns is diagrammatically illustrated with arrows 37.

Figure 6:
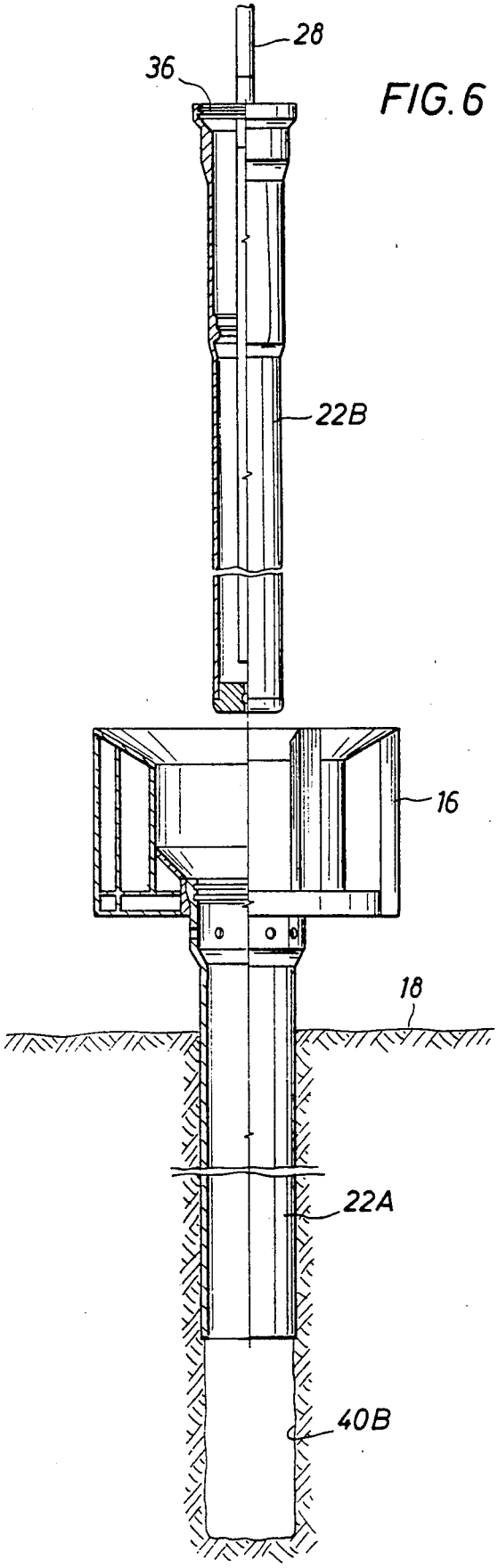
FIG. 6 is a partially cross-sectioned side elevational view illustrating the conductor casing being run into the subsea wellhead.

Operations drilling this interval continue until the conductor borehole is at least as long as necessary to accommodate the conductor casing. Then, drill string 28 is retrieved and conductor casing 22B is made up on running tool connection 36 of the drill string; see FIG. 6 which illustrates running conductor casing 22B on drill string 28 for insertion through wellhead 16, structural casing 22A and the length of conductor borehole 40B.

The conductor casing seals off this initial drilling and extends generally into only mud and soft sediment which is incompetent to hold any significant geothermal pressures. Thus, well control over this interval is not a concern and it is not necessary to maintain a hydrostatic head on the borehole wall from the riser. Thus, drilling for this interval can safely proceed without a riser.

Figure 7:
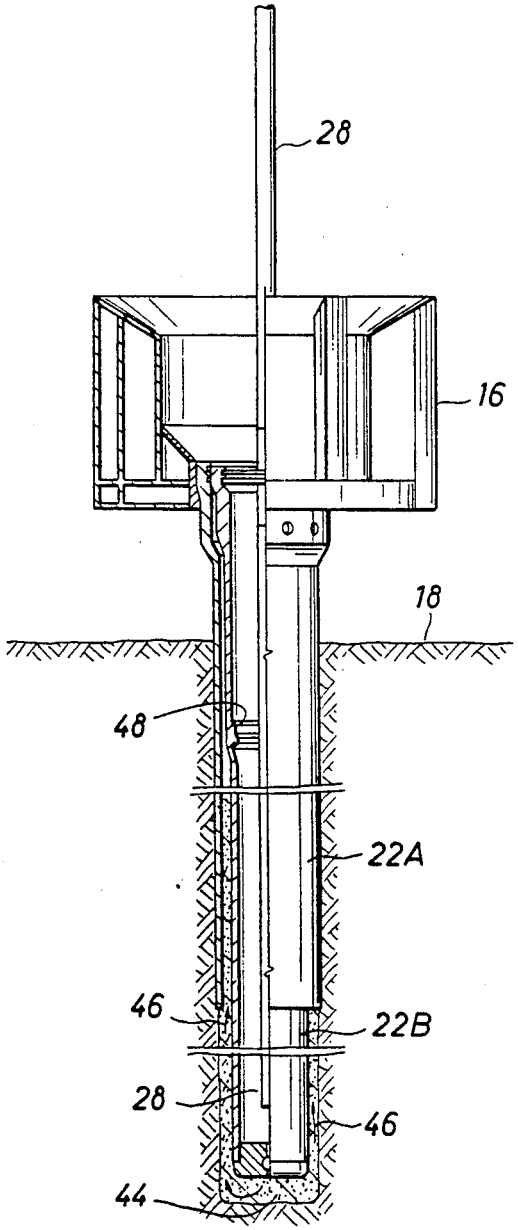
FIG. 7 is a partially cross-sectioned side elevational view illustrating the conductor casing in place and being cemented.

FIG. 7 illustrates conductor casing 22B landed within wellhead 16 and with cementing operations in which cement is circulated into the annulus 42 between conductor casing 22B and the wall of conductor borehole 40B. The circulation of cement 44 is generally illustrated with arrows 46. Notice also that conductor casing 22B seals ports 35 and provides a load and seal area 48 for receiving a surface casing.

Figure 8:
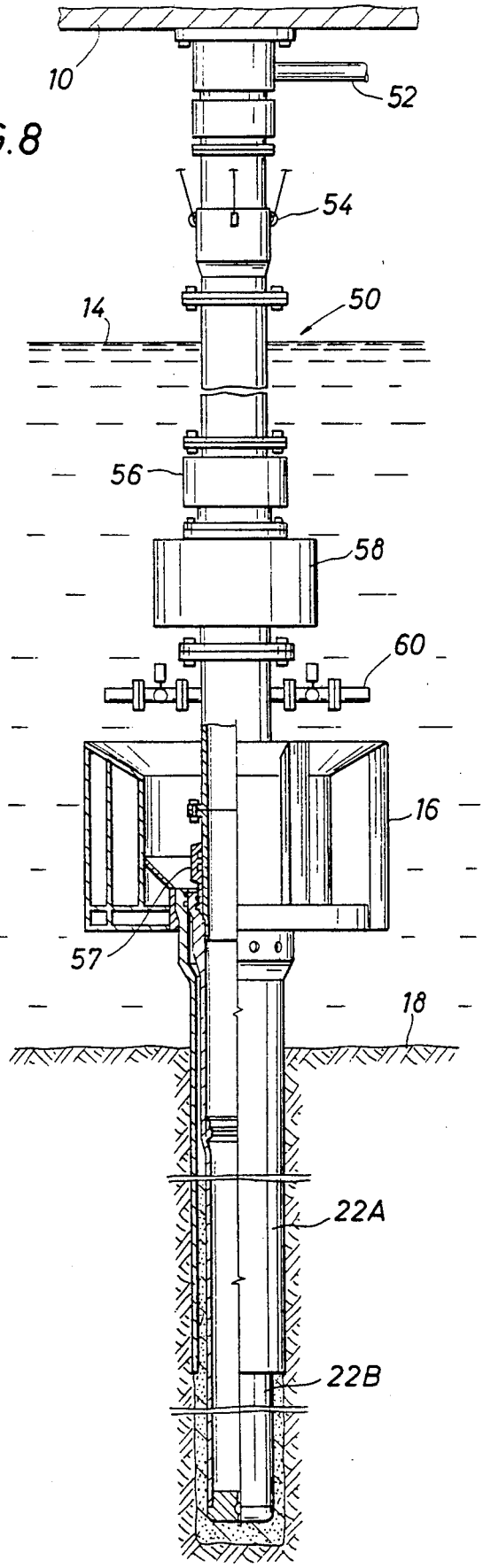
FIG. 8 is a partially cross-sectioned side elevational view of a large diameter, light duty riser connected to the subsea wellhead.

After cementing, drill string 28 is retrieved and a first riser is lowered into place. See FIG. 8. Unlike the conductor borehole, a well plan to minimize the number of casing strings and maximize the internal diameter of the wellbore during critical initial stages will require that the next interval drilled extend into the depths in formations capable of holding geopressure. Therefore, a riser is desired for drilling the next interval.

This first riser 50 is a large diameter riser which, in the preferred embodiment, is a light duty riser designed for use only with relatively light drilling mud. Since it is designed for light weight mud, the first riser can provide a greater inside diameter without greatly increasing the weight or direct cost of the riser. This also helps to control the indirect cost of the riser in not requiring the buoyancy necessary to offset the increased weight that a riser having the same large internal diameter would entail if provided with the strength for using heavy drilling muds.

First riser 50 receives the drill string at its top at surface facility 10 and provides an outlet 52 for the annular flow drilling mud and cuttings returned. Further, floating surface facilities will be subject to wave action and a tensioned telescopic connection 54 adjacent surface facilities 10 is necessary to maintain compensated tension over the first riser in order to prevent buckling failure. A flexjoint 56 near subsea wellhead 16 also helps isolate the wellhead from motions at the surface by allowing angular flexure of the riser. Connector 57, preferably an hydraulically actuated pin connection, secures secure the riser to the subsea wellhead.

An annular preventer 58 helps control the well and diverters 60 will vent away any minor gas kicks encountered during drilling operations over the next interval.

Figure 9:
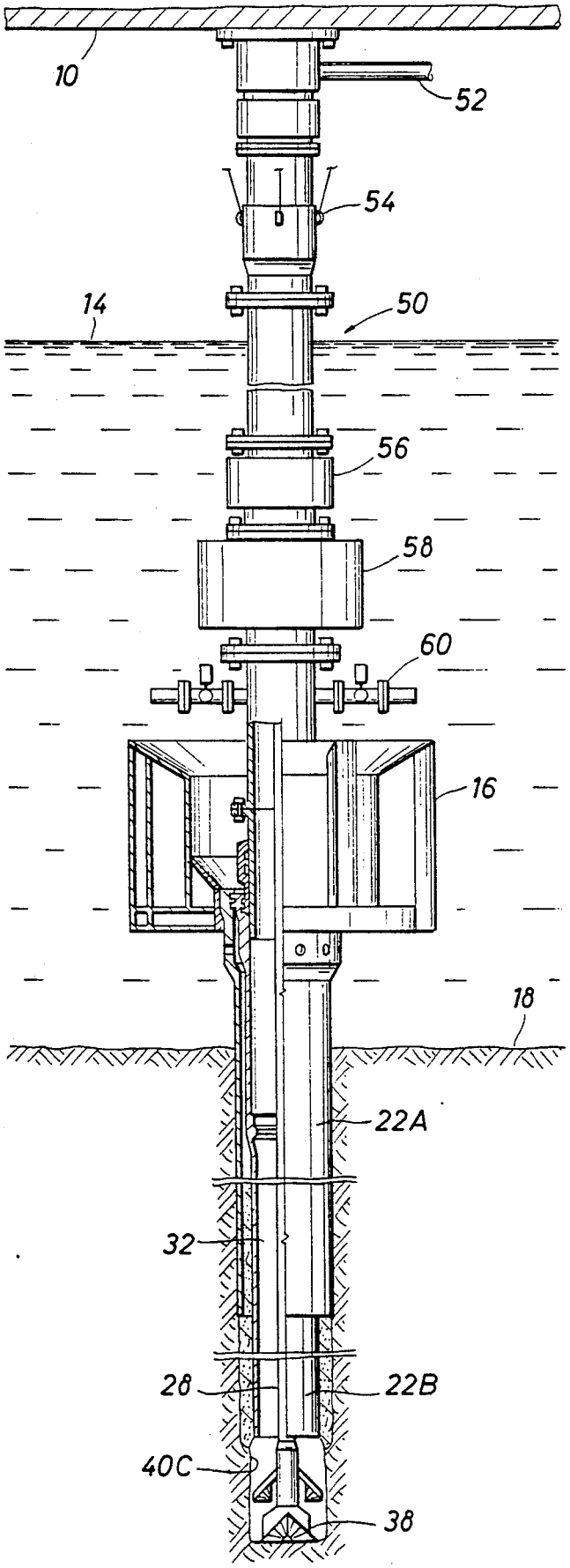
FIG. 9 is a partially cross-sectioned side elevational view illustrating drilling the surface hole.

FIG. 9 illustrates the resumption of drilling with drill bit 38 on the end of drill string 28 extending through first riser 50. The large diameter of light duty first riser 50 permits use of a larger diameter drill bit which, preferably, drills a surface borehole 40C in one pass which is capable of receiving the largest diameter surface casing which conductor casing 22B will dependably pass.

Figure 10:
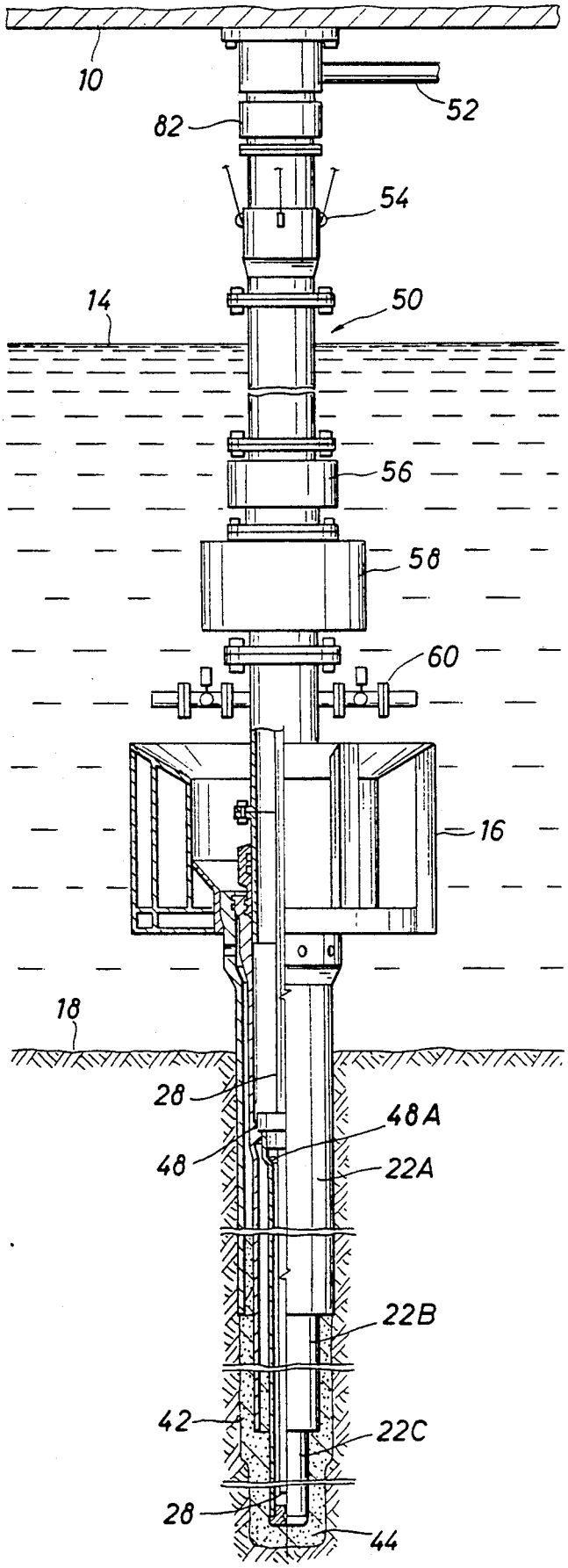
FIG. 10 is a partially cross-sectioned side elevational view illustrating the surface casing being cemented into place.

Drilling mud circulated down the drill string cools the bit and sweeps away cuttings from the bit face, carrying the cuttings up annulus 32 of the borehole and its continuation within the riser and exiting the riser through outlet 52. The hydrostatic head of the drilling mud also controls the well as drilling advances throughout the surface borehole interval 40C. This also controls the wells on trips necessary to change the bit. In addition, the large diameter light duty riser allows the passage of surface casing 22C, see FIG. 10, such that the well may be controlled throughout casing operations.

The passage of surface casing 26C through first riser 50 is also facilitated by separating the high pressure housing from the surface casing and providing load and seal area 48 within conductor casing 22B for landing the surface casing 26C. The exterior dimensions of the profile 48A necessary to securely seat at load and seal area 48 is less than that required by the integral surface casing and high pressure housing of the prior art.

Figure 11:
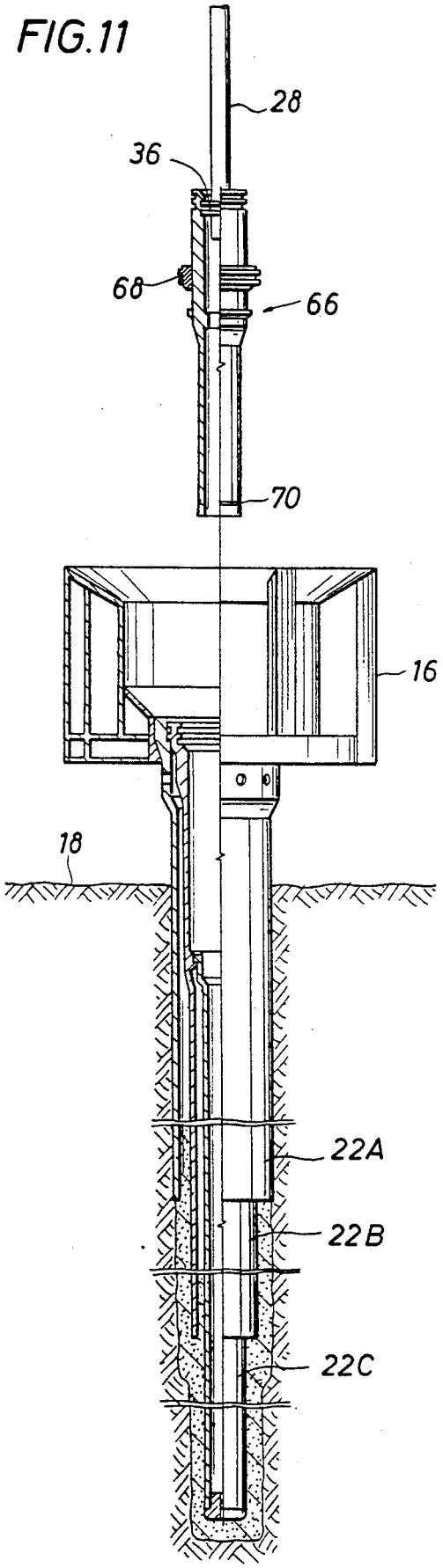
FIG. 11 is a partially cross-sectioned elevational view of the wellhead following removal of the light duty riser and illustrating the approach of the high pressure housing to the subsea wellhead.

After surface casing string 22C lands at load and seal area 48, cement 44 is pumped through drill string 28 upon which the surface casing is run and this cement fills up the annular space 42 between the exterior of the surface casing and the wall of surface borehole 40B. Thereafter, the running tool connection 36 is disengaged from surface casing 22C and the drill string is retrieved through first riser 50. It is preferred to activate the seal at load and seal area 48 with the running tool to secure the seal between the surface and conductor casings after cement 44 is in place and before removing the riser and the hydrostatic control it provides. Thereafter, riser 50 may be safely removed from subsea wellhead 16 and the high pressure housing may be inserted into the subsea wellhead. See FIG. 11.

Figure 12:
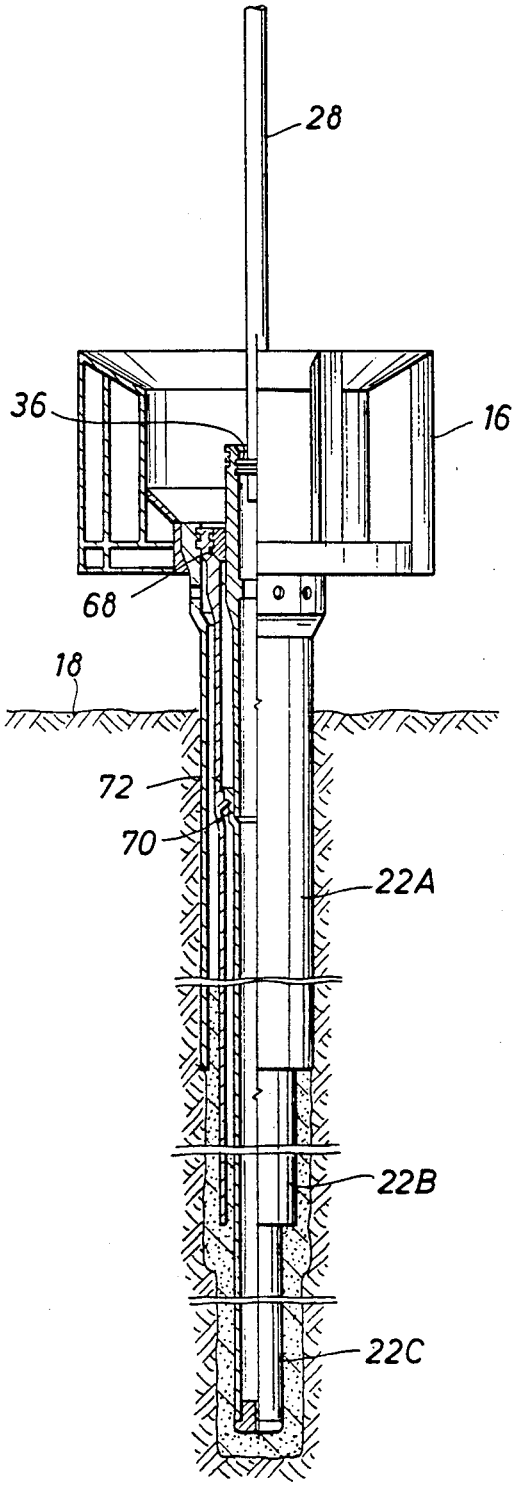
FIG. 12 is a partially cross-sectioned side elevational view illustrating the connection of the high pressure housing to the subsea wellhead.

High pressure housing 66 is run on drill string 28 after makeup at running tool connection 36. The high pressure housing has a profile providing a load shoulder and lockdown 68 for securing the housing within the subsea wellhead and extends to seal stab 70 or other means for effecting a seal with the top of surface casing 22C. FIG. 12 illustrates the preferred embodiment of this connection in which the high pressure housing of lands within subsea wellhead 16 with the load and shoulder lockdown 68 engaging the top of conductor casing 22B and seal stab 70 engaging the top of surface casing 22C at tieback sleeve 72.

Figure 13:
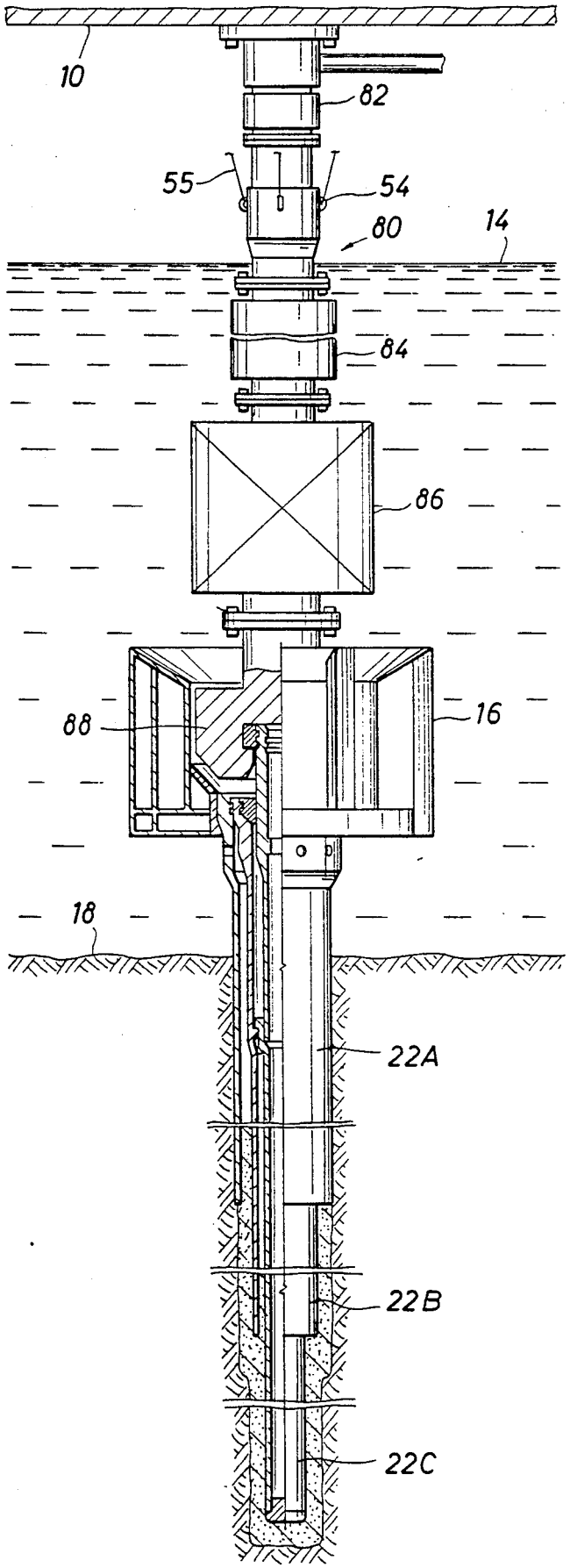
FIG. 13 is a partially cross-sectioned side elevational view illustrating the connection of a heavy duty riser to the subsea wellhead for proceeding with the drilling operations.

The drill string releases housing 62 and is retrieved after the high pressure housing is fully secured to subsea wellhead 16. Drilling can now proceed conventionally with a traditional heavy duty second riser 80. See FIG. 13.

In the preferred embodiment, heavy duty second riser 80 is designed to handle any mud loads necessary to control the well throughout the remainder of the drilling program and the interior dimensions will allow passage of remaining drill bits and subsequent casing. Here, second riser 80 provides a ball joint 82 adjacent surface facility 10. Ball joint 82 cooperates with tensioned telescopic connection 54 in allowing for relative motion between surface facility 10 and subsea wellhead 16 induced by wave action at surface 14. The riser is preferentially provided with buoyancy means 84 such as air cans, syntactic foam or the like to lessen the load on tensioners 55 at telescopic connection 54 and ultimately on surface facility 10.

A subsea blowout preventer 86 is provided in second riser 80 adjacent wellhead 16 and the second riser is connected to the subsea wellhead through an hydraulic connector 88 sealingly engaging the high pressure housing.

The economics of using the present two-riser method of drilling can be enhanced with batch drilling programs, drilling multiple wells through the setting of the surface casing before proceeding with operations employing the heavy duty second riser. This eliminates the inefficiencies of frequent loading and offloading of first and second risers.

The present invention provides larger diameter early risers which can be used in subsequent drilling to provide additional tolerances for highly deviated intervals, or to eliminate the need for under-reaming or to permit additional intervals for greater depth.

Other modifications, changes and substitutions are intended in the foregoing disclosure and in some instances some features of the invention will be employed without a corresponding use of other features. Accordingly, it is appropriate that the pending claims be construed broadly and in a manner consistent with the spirit and scope of the invention herein.

What is claimed is:

1. A method for offshore drilling in deepwater, comprising:

drilling a surface interval through a light duty first riser attached to a subsea wellhead;

setting surface casing through the first riser;

retrieving the first riser;

setting a high pressure housing in sealing engagement with the top of the surface casing;

securing a heavy duty second riser to the subsea wellhead in sealed communication with the high pressure housing; and conducting further drilling operations through the second riser.

2. A method for drilling in accordance with claim 1, further comprising:

setting the subsea wellhead on the ocean floor, comprising:

running the subsea wellhead and an attached structural casing to the ocean floor on a drill string which carries a jetting assembly which projects from beneath the structural casing;

jetting the structural casing into the ocean floor by pumping drilling fluids down the drill string which flushes soft sediments up the annulus between the drill string and the concentric structural casing; and releasing the subsea wellhead from the drill string.

3. A method for drilling in accordance with claim 2, further comprising:

running the drill string with a drill bit attached through the subsea wellhead and structural casing;

driving the drill bit while pumping drilling fluid down the drill string, returning cuttings to the ocean floor;

retrieving the drill string; and setting the conductor, comprising:

running the conductor casing on the drill string down the subsea wellhead and through the structural casing;

landing the top of the conductor casing in the subsea wellhead; and pumping cement down the drill string and into the annulus between the conductor casing and a conductor borehole wall.

4. A drilling method in accordance with claim 3, wherein drilling a surface interval further comprises:

clamping the first riser to the top of the conductor casing within the subsea wellhead;

running the drill string with the drill bit attached through the first riser, subsea wellhead, structural casing and conductor casing; and driving the drill bit while pumping drilling fluid, returning cuttings up the annulus through the conducting casing, structural casing, and up the riser to discharge from an outlet at the top of the riser.

5. A drilling method in accordance with claim 4, wherein setting the surface casing further comprises:

running the surface casing down the riser on the drill string while retaining a hydrostatic head on the formation;

landing a profile at the top of the surface casing onto a load and seal area presented on the interior of the conductor casing;

pumping cement down the drill string and into an annulus between the surface borehole wall and the surface casing; and allowing the concrete to set while maintaining the hydrostatic head to control the well.

6. A drilling method in accordance with claim 5, further comprising packing off the cemented conductor casing and testing the seal to determine if it will retain pressure.

7. A two riser method for offshore drilling in deep water comprising:

setting a subsea wellhead having a structural casing;

setting a conductor casing within the structural casing;

securing a light duty first riser to the subsea wellhead;

setting a surface casing within the conductor casing through the first riser;

retrieving the first riser;

setting a high pressure housing in sealing engagement with the top of the surface casing;

securing a heavy duty second riser to the subsea wellhead in communication with the high pressure housing; and conducting further drilling operations through the second riser.

8. A method for drilling in accordance with claim 7, wherein setting the subsea wellhead on the ocean floor, comprises:

running the subsea wellhead and an attached structural casing to the ocean floor on a drill string which carries a jetting assembly which projects from beneath the structural casing;

jetting the structural casing into the ocean floor by pumping drilling fluids down the drill string which flushes soft sediments up the annulus between the drill string and the concentric structural casing; and releasing the subsea wellhead from the drill string.

9. A method for drilling in accordance with claim 8, further comprising:

running the drill string with a drill bit attached through the subsea wellhead and structural casing;

driving the drill bit while pumping drilling fluid down the drill string, returning cuttings to the ocean floor;

retrieving the drill string; and wherein setting the conductor casing further comprises:

running the conductor casing on the drill string down the subsea wellhead and through the structural casing;

landing the top of the conductor casing in the subsea wellhead; and pumping cement down the drill string and into the annulus between the conductor casing and a conductor borehole wall.

10. A drilling method in accordance with claim 9, further comprising:

drilling a surface interval, comprising:

clamping the first riser to the top of the conductor casing within the subsea wellhead;

running the drill string with the drill bit attached through the first riser, subsea wellhead, structural casing and conductor casing; and driving the drill bit while pumping drilling fluid, returning cuttings up the annulus through the conducting casing, structural casing, and up the riser to discharge from an outlet at the top of the riser.

11. A drilling method in accordance with claim 10, wherein setting the surface casing further comprises:

running the surface casing down the riser on the drill string while retaining a hydrostatic head on the formation;

landing a profile at the top of the surface casing onto a load and seal area presented on the interior of the conductor casing;

pumping cement down the drill string and into an annulus between the surface borehole wall and the surface casing; and allowing the concrete to set while maintaining the hydrostatic head to control the well.

12. A drilling method in accordance with claim 11, further comprising packing off the cemented conductor casing and testing the seal to determine if it will retain pressure.

13. A two-riser method for offshore drilling comprising:

setting a subsea wellhead having a structural casing;

setting a conductor casing within the structural casing;

securing a light weight first riser having a subsea diverter system to the subsea wellhead;

setting a surface casing within the conductor casing through the first riser;

retrieving the first riser;

setting a high pressure housing within the wellhead in sealing engagement with the top of the surface casing;

securing a high pressure second riser to the subsea wellhead in communication with well bore and sealed to the high pressure housing; and conducting further drilling operations through the second riser.

14. A two-riser method for offshore drilling comprising:

setting a large diameter subsea wellhead having a large diameter structural casing;

setting a conductor casing within the structural casing;

securing a light weight first riser having a subsea diverter system to the subsea wellhead;

setting a surface casing within the conductor casing through the first riser, comprising:

drilling a significant interval of surface hole through the first riser, diverting the returns from the riser near the mud line;

running surface casing into the surface hole through the first riser; and cementing the surface casing in secure sealing contact with the walls of the surface hole;

retrieving the first riser;

setting a high pressure housing within the wellhead in sealing engagement with the top of the surface casing;

securing a high pressure second riser to the subsea wellhead in communication with wellbore and sealed to the high pressure housing, said second riser having an internal diameter which is less than the outside diameter of the high pressure housing; and conducting further drilling operations through the second riser.

15. A method of offshore drilling, comprising:

securing a drill string supported by drawworks provided on a surface vessel to a large diameter subsea wellhead and large diameter structural casing;

running the drill string from the surface vessel to place the wellhead and structural casing at a selected well site at a mudline on the ocean floor;

jetting the large diameter structural casing into the ocean floor through the subsea wellhead and structural casing to set the structural casing and secure the subsea wellhead at the ocean floor;

drilling a large diameter conductor borehole through the structural casing, releasing the returns at the mudline;

retrieving the drill string;

running a large diameter conductor casing into the conductor borehole and securing it to the subsea wellhead;

cementing the conductor casing in place within the conductor borehole;

running a light weight riser having a subsea diverter system to the subsea wellhead and connecting the riser to the wellhead;

drilling a surface hole through the light weight riser;

running surface casing into the surface hole through the light weight riser and landing the surface casing onto receiving means at the top of the conductor casing;

cementing the surface casing in place within the surface hole and testing the seal;

displacing the light weight riser with seawater, disengaging and retrieving the light weight riser;

running a high pressure housing to the subsea wellhead and securing it in a sealing engagement at the top of the surface casing with a tieback receptacle; and resuming the drilling program through a high pressure riser.

* * * * *